US005638733A

United States Patent [19]

Brazzo

[11] Patent Number: 5,638,733

[45] Date of Patent: Jun. 17, 1997

[54] ROTARY DIE CUTTER UNIT WITH RAPID DIE CONNECTION

[75] Inventor: Roberto Brazzo, San Giuliano Nuovo, Italy

[73] Assignee: Texo s.r.l., M. To, Italy

[21] Appl. No.: 522,677

[22] Filed: Sep. 1, 1995

[51] Int. Cl.[6] ..... B26D 7/26

[52] U.S. Cl. ..... 83/698.41; 83/665; 83/331; 101/378; 101/382.1; 493/471

[58] Field of Search ..... 83/698.31, 698.41, 83/698.42, 698.51, 698.61, 41, 331, 346, 347, 343, 659, 665, 698.11; 101/378, 382.1, 383, 384, 385, DIG. 36; 493/370, 371, 471

[56] References Cited

U.S. PATENT DOCUMENTS

| | | | |
|---|---|---|---|
| 2,180,732 | 11/1939 | Durham | 101/378 |
| 2,236,230 | 3/1941 | Worthington | 101/378 |
| 2,623,462 | 12/1952 | Crabtree et al. | 101/378 |
| 2,630,756 | 3/1953 | Crabtree et al. | 101/378 |
| 2,639,668 | 5/1953 | Chase et al. | 101/378 |
| 2,667,834 | 2/1954 | Ziebell | 101/378 |
| 2,679,802 | 6/1954 | Crafts | 101/378 |
| 2,709,405 | 5/1955 | McWhorter | 101/378 |
| 5,003,854 | 4/1991 | Capdebosco | 83/698.42 X |
| 5,379,671 | 1/1995 | Kang | 83/698.51 X |

FOREIGN PATENT DOCUMENTS 0384161 8/1990 European Pat. Off. .

*Primary Examiner*—Rinaldi I. Rada
*Assistant Examiner*—Clark F. Dexter
*Attorney, Agent, or Firm*—Helfgott & Karas, P.C.

[57] ABSTRACT

A rotary die cutter unit with rapid die connection has a die equipped with connecting bars, and a die-holding cylinder. The die-holding cylinder has longitudinal grooves with openings receiving the bars when connecting the die to the die-holding cylinder. Connecting teeth, which are housed in the openings of the grooves, circumferentially move on the cylinder, and assume a non-connected position in which they are completely moved out from the grooves, and a connected position in which they protrude into the grooves. Control elements corresponding to the grooves are provided, having small irregular teeth with one of the two sides whose height is progressively decreasing in the form of a chute. The control elements, when longitudinally moving, act on roller bearings to gradually move the connecting teeth between their two extreme connected and non-connected positions.

1 Claim, 3 Drawing Sheets

ROTARY DIE CUTTER UNIT WITH RAPID DIE CONNECTION

BACKGROUND OF THE INVENTION

1. Field of the Invention

The present invention refers to a rotary die cutter unit with rapid die connection, for cardboard shapes for boxes, that is part of a shape-production line, that prints, feeds and cuts the shapes themselves through such rotary die cutter unit, before cleaning, stacking and placing them on pallets to ship them.

2. Description of Prior Art

Various types of rotary die cutter units are known in the art, comprising a rotary die-holding cylinder, on which a wooden die with inserted blades is mounted to cut and shape the cardboard, according to the type of box to be produced. The major problem for all known devices built so far has been prearranging an effective connection between the die-holding cylinder and the die, that guarantees an easy and quick replacement, contact efficiency between the two parts for shape die-cutting accuracy, and optimal operating life.

In addition to the old type of connection with common screws, that surely is not the optimum solution due to its cumbersome and long operations, above all if frequent die changes occur, the most recent technical solutions are those disclosed in European Patent No. 0 384 161 in the name of Martin and in Italian Patent Application No. TO92A000177 assigned to the same Assignee of the present invention. The solution described in European Patent No. 0 384 161 shows connecting half-circumferences on the die that come into engagement with grooves on the cylinder and are kept engaged by longitudinal bars pushed against them; however, in addition to sliding problems for the bars in dusty environments, this solution has a problem dealing with connection accuracy, that is not uniform if, due to any reason, the bar is not able to couple all half-circumferences on the die: since the bar has a single working stroke, connection misalignments, that are frequent in harsh environments like the cardboard cutting ones, are transmitted on the whole bar impairing contact accuracy between die and cylinder.

On the other hand, the solution described in Italian Patent Application No. TO92A000177, though solving the previously mentioned problems, is difficult to realize, due both to costs and to the great number of connecting devices used.

SUMMARY OF THE INVENTION

It is an object of the present invention, therefore, to solve the above-mentioned problems, providing a rotary die cutter unit that guarantees a high connection accuracy between the die and cylinder, imparting a circumferential type of connection force generated by a simple longitudinal movement of a control stick; the solution is further of a simple construction and shows high reliability under difficult environmental conditions (dust, moisture, etc.).

The above and other purposes and advantages of the invention, as will appear from the following description, are obtained with a rotary die cutter unit with rapid die connection, comprising at least a semicircular die and a die-holding cylinder, wherein:

said die is equipped with a plurality of longitudinal connecting bars having a C-shaped section, said longitudinal bars being secured to said die in connection positions;

said die-holding cylinder is equipped with:

a plurality of longitudinal grooves in a position corresponding to said longitudinal connecting bars, said grooves being equipped with a plurality of openings along a length thereof, said grooves being adapted to receive said connecting bars during a connection step of said die to said die-holding cylinder;

a plurality of connecting teeth, each being housed in one of said plurality of openings in said grooves, said connecting teeth being able to circumferentially move with respect to said die-holding cylinder, and being able to assume an non-connection position in which they are completely retracted into said openings and disappear from said groove, and a connection position in which they protrude into said groove;

a plurality of longitudinal control sticks inserted in said cylinder, each one next to each of said longitudinal grooves, said control sticks having a side with an irregular toothed shape equipped with a plurality of small teeth, each one of said small teeth having an upper plane part with a one side having a sharp edge and another side whose height is progressively decreasing in the form of a chute, said control sticks when longitudinally moving being adapted to cooperate, through said small irregular teeth thereof, with a plurality of roller bearings connected to said connecting teeth to gradually move said connecting teeth between said two extreme connection and non-connection positions.

The present invention will be better described by some preferred embodiments thereof, provided as a non limiting example, with reference to the accompanying drawings.

DESCRIPTION OF PREFERRED EMBODIMENTS

Figure 1:
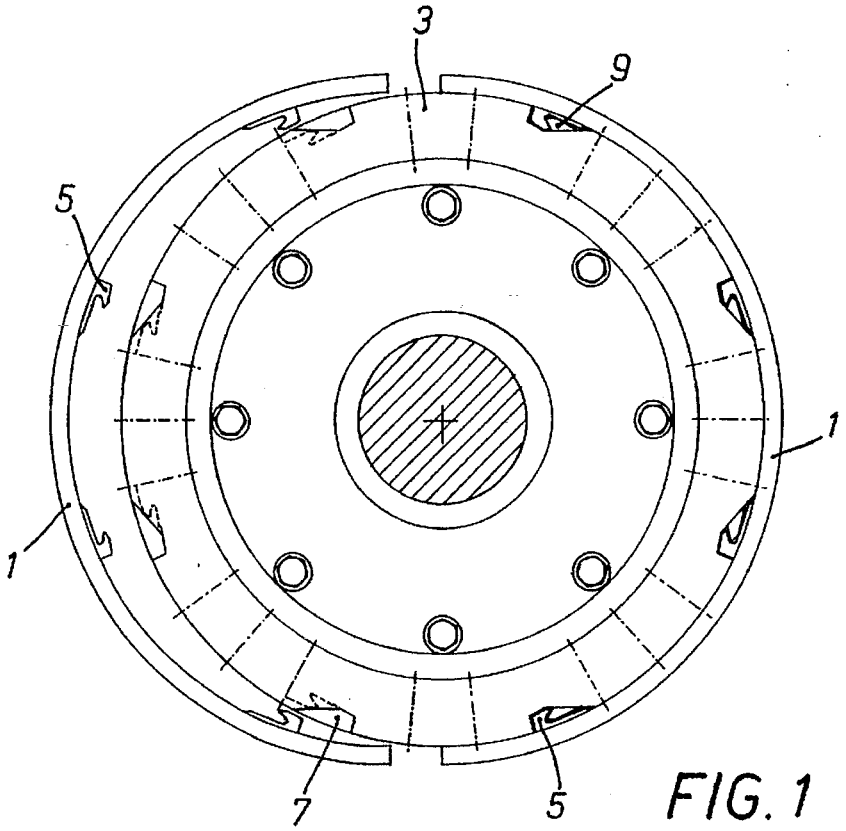
FIG. 1 is a front view of an embodiment of the die cutter unit according to the present invention pointing out, on the right side, the connection condition between die and cylinder and, on the left side, the non-connection condition with hooks in a retracted position.

With reference to the Figures, a rotary die cutter unit with rapid die connection, for cardboard shapes for boxes, substantially comprises at least one (and usually two) wooden semicircular die 1 and a die-holding cylinder 3, that are shown in the connection and unconnection (i.e. non-connection) positions thereof respectively on the right and left sides in FIG. 1. As appears evident when examining FIG. 1, the die 1 is equipped with a plurality of longitudinal connecting bars 5, with a very bent, C-shaped section: these longitudinal bars 5 are secured to the die 1 through common securing means, for example screws, in the provided connection positions, that, in the preferred embodiment described here, are four, mutually equidistant on every half-circumference of the die 1. To realize the connection step shown on the right side in FIG. 1, it will be necessary to prearrange connecting means cooperating with the bars 5 and that can be moved between an engagement position and a disengagement position, for example a "disappearing" one, before connecting a new die and to allow also unconnecting the already coupled die.

To realize such connecting means, the die-holding cylinder 3, first of all, is equipped with a plurality of longitudinal grooves 7 in a position respectively corresponding to that of the longitudinal connecting bars 5. The grooves 7 are equipped with a plurality of openings obtained at regular intervals along the length thereof and which receive, inside them, the connecting bars 5 during the connection step of the die 1 to the die-holding cylinder 3.

The cylinder 3 is further equipped with a plurality of connecting teeth 9, each one housed in one of the openings in the longitudinal grooves 7. These connecting teeth 9 are able, as will be described below, to circumferentially move with respect to the die-holding cylinder 3, and assume an non-connection position in which they are completely retracted into the openings and disappear from the groove 7 (as shown on the left side in FIG. 1), and a connection position in which they protrude into the groove 7 to engage the longitudinal bars 5 on the die 1 (as shown on the right side in FIG. 1).

Figure 4:
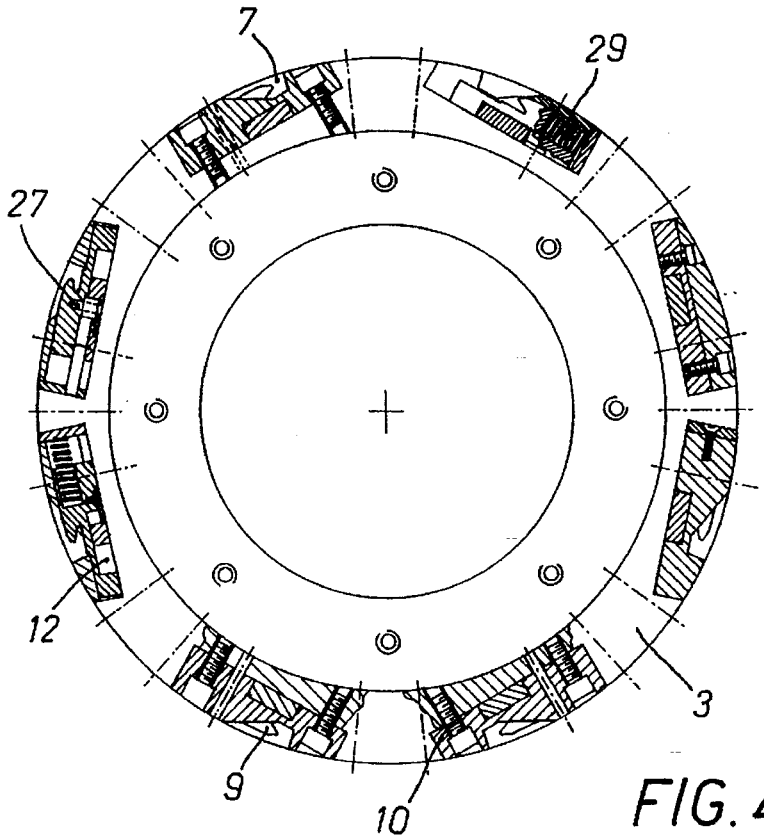
FIG. 4 is a front view, partially in section, of the die-holding cylinder where constructive and operating features of securing hooks are shown.

The connecting teeth 9 operate in the respective openings through a constructive solution secured to the cylinder 3 through screws 10 (FIG. 4).

In order to be able to perform displacement of the connecting teeth 9, a plurality of longitudinal control sticks or rods 11 have been provided, each one placed, inside the cylinder 3, next to each of the longitudinal grooves 7 and sliding into the recesses 12 in the cylinder 3. These control sticks 11 have a side 13 of an irregular toothed shape: each one of the small camming teeth 15 thereof has an upper plane part 17 with a side 18 with a sharp edge and another side 19 whose thickness is progressively decreasing in order to form a sort of chute. Every control stick 11 is terminated on one end by a small rod 21 that protrudes from one side of the die-holding cylinder 3; the opposite end 22 is engaged with a return spring 23 to bring back the stick 11 to its rest position, next to which the connecting teeth 9 protrude from the grooves 7 and perform the connection. The small irregular teeth 15 of the control sticks 11 push, by acting on their side 19, corresponding roller bearings 25 that are secured, through adequate pins 27, to each one of the connecting teeth 9. Pushing, operating along a circumferential direction, of the stick 11 on the bearings 25 generates a circumferential movement of the connecting teeth 9 opposing the force of the springs 29 connected to one end of the connecting teeth 9 themselves: the circumferential movement is such that the connecting teeth 9 completely disappear from the grooves 7 being retracted in the adequate openings that are housing them. Purpose of the springs 29 is bringing back the teeth to an engagement position when connecting the die 1.

The connection/unconnection step of the die 1 from the rotary die cutter unit according to the present invention, will now be described.

Figure 2:
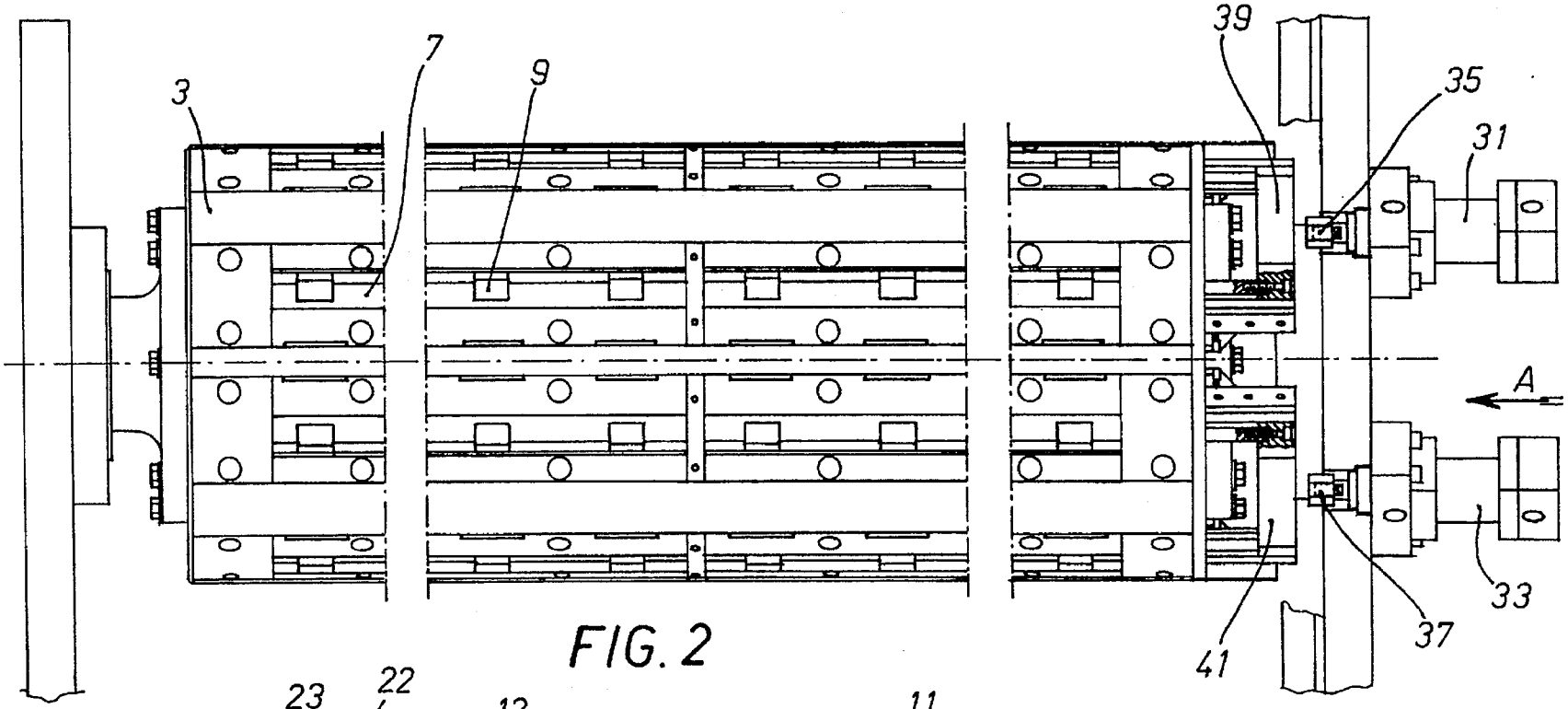
FIG. 2 is a reduced side view of the die-holding cylinder according to the present invention.
Figure 3:
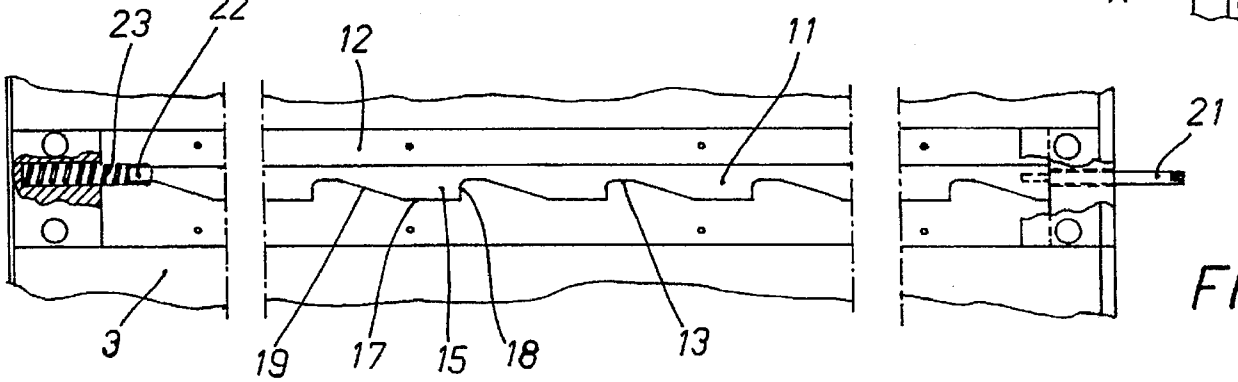
FIG. 3 is a reduced side view of the stick controlling hook movement.
Figure 5:
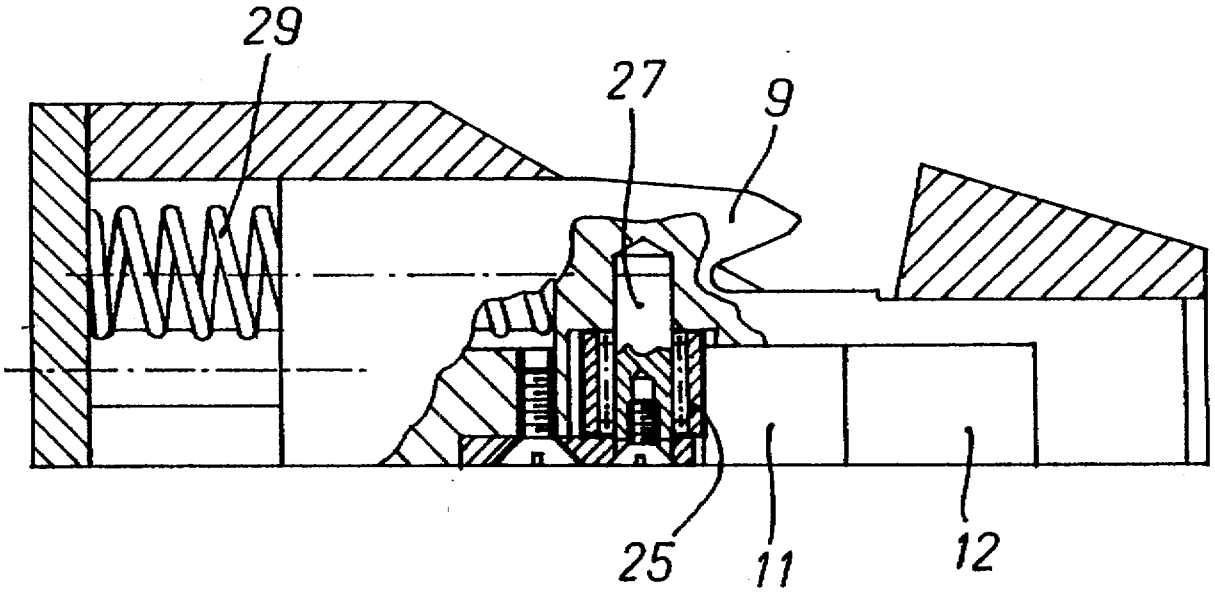
FIG. 5 is an enlarged side view, partially in section, of an embodiment of the securing hook.

When it is necessary to carry out the replacement of a die 1 on the die-holding cylinder 3, to uncouple the previous die 1 a pair of pistons 31 and 33 are actuated that push, through respective small blocks 35 and 37 and along the direction shown by arrow A FIG. 2, suitable plates 39 and 41 connected to the small rods 21 of the control sticks 11. Pushing of the pistons 31 and 33 makes the control sticks 11 move along the longitudinal direction with respect to the die-holding cylinder 3 for a length that is exactly equal to the length of the side 19 "in the form of a chute", opposing the return force of the spring 23. The side 19 hits against the roller bearing 25 and pushes backwards, along the circumferential direction, all connecting teeth 9, making them disappear from the grooves 7. After having removed the old die 1 and having placed the new one in position, the action of pistons 31 and 33 is stopped and therefore the force of the return springs 23 of the control sticks 11 and the force of the springs 29 acting on the various connecting teeth 9 make both sticks 11, and teeth 9 go back to the initial position, that corresponds for the teeth 9 to the complete protrusion in the grooves 7 and therefore to the connection engagement with the bars 5 on the die 1.

Although the present invention has been described with reference to preferred embodiments, numerous modifications and rearrangements can be made, and still the result will come within the scope of the invention.

I claim:

1. A rotary die cutter unit with rapid die connection, comprising a die-holding cylinder and at least one semicircular die removably mounted on the die-holding cylinder, said die including a plurality of longitudinal connecting bars each having a C-shaped portion, said longitudinal connecting bars being secured to said die in respecting a mounting position on of said die with;

including a plurality of longitudinal grooves in respective positions corresponding said mounting positions of said longitudinal connecting bars for cooperating with said longitudinal connecting bars, said grooves having a plurality of openings therein spaced along a length thereof, and said grooves receiving said longitudinal connecting bars;

a plurality of connecting teeth, said plurality of openings in said grooves respectively housing said connecting teeth in a non-connection position;

means for moving said connecting teeth circumferentially with respect to said die-holding cylinder to assume the non-connection position in which said connecting teeth are completely retracted out of said grooves and into said openings and disappear from said grooves, and a connection position in which said connecting teeth protrude into said grooves;

said moving means including a plurality of longitudinal control sticks inserted in said cylinder, each one next to a respective one of said longitudinal grooves and operably connected to said connecting teeth for moving said connecting teeth with respect to said die-holding cylinder, said control sticks each having a side with a plurality of camming teeth thereon, each camming tooth having an upper plane part, a first side which is substantially perpendicular to said upper plane part, and a second side which slopes away from said upper plane part such that the height of the second side progressively decreases, said control sticks being operably connected to said connecting teeth by a plurality of roller bearings, said roller bearings being connected to said connecting teeth, whereby when longitudinally moving said control sticks, said camming teeth cooperate with said roller to gradually move said connecting teeth between said connection position and said non-connection position.

* * * * *